US012467703B2

(12) United States Patent
Esplin et al.

(10) Patent No.: US 12,467,703 B2
(45) Date of Patent: Nov. 11, 2025

(54) CARTRIDGES FOR RECOIL MANAGEMENT OF SHOULDER FIRED WEAPONS

(71) Applicant: Raytheon Company, Tewksbury, MA (US)

(72) Inventors: Roger C. Esplin, Marana, AZ (US); Daniel Kenneth Johnson, Golden, CO (US); Morgan J. Bakarich, Tucson, AZ (US); Saeed Adil Merza, Palmetto, FL (US); Gary Leonard Abrams, Oro Valley, AZ (US); Cody Alan Jensen, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/684,949

(22) PCT Filed: Aug. 17, 2022

(86) PCT No.: PCT/US2022/040556
§ 371 (c)(1),
(2) Date: Feb. 20, 2024

(87) PCT Pub. No.: WO2023/023124
PCT Pub. Date: Feb. 23, 2023

(65) Prior Publication Data

US 2024/0369332 A1 Nov. 7, 2024

Related U.S. Application Data

(60) Provisional application No. 63/234,465, filed on Aug. 18, 2021.

(51) Int. Cl.

| | |
|---|---|
| ***F42B 5/16*** | (2006.01) |
| ***F41A 1/08*** | (2006.01) |
| ***F42C 19/08*** | (2006.01) |

(52) U.S. Cl.
CPC ..... *F41A 1/08* (2013.01); *F42B 5/16* (2013.01); *F42C 19/0807* (2013.01); *F42C 19/0826* (2013.01)

(58) Field of Classification Search
CPC ..... F42B 5/05; F42B 5/02; F42B 5/16; F42C 19/0807; F42C 19/0826; F41A 1/08; F41F 3/00
See application file for complete search history.

(56) References Cited

U.S. PATENT DOCUMENTS 540,326 A 6/1895 Maxim
2,651,972 A * 9/1953 Engelke ..... F42B 5/05 89/1.7

(Continued)

FOREIGN PATENT DOCUMENTS

CH 651131 A5 8/1985
DE 202016001843 U1 6/2016

(Continued)

OTHER PUBLICATIONS

International Search Report and Written Opinion dated Apr. 25, 2023 for PCT/US2022/040556.

(Continued)

*Primary Examiner* — Benjamin P Lee
(74) *Attorney, Agent, or Firm* — Bachman & LaPointe, P.C.

(57) ABSTRACT

A cartridge (20) has a cartridge case (22) extending along an axis (500) from a base (104) to a mouth (102) and having an interior. A projectile (24) is mounted in the case. A propellant (26) is contained within the case. The propellant has an annular grain encircling the axis.

21 Claims, 7 Drawing Sheets

(56) References Cited

U.S. PATENT DOCUMENTS 2,741,160 A * 4/1956 Musser ..... F41A 1/08 89/27.11
3,264,997 A 8/1966 Michael
3,426,684 A * 2/1969 Ek ..... F42B 5/24 102/435
3,490,330 A * 1/1970 Willi ..... F41A 1/08 89/14.6
3,546,997 A * 12/1970 Biehl ..... F42B 5/025 86/1.1
3,905,846 A * 9/1975 Berta ..... C06B 23/007 149/19.8
4,091,730 A * 5/1978 Dardick ..... F42B 8/04 102/436
4,098,190 A * 7/1978 Gawlick ..... F42C 19/083 102/445
4,128,443 A 12/1978 Pawlak et al.
4,132,149 A * 1/1979 Ashley ..... F42B 5/16 89/7
4,386,569 A * 6/1983 Deas ..... C06B 45/00 102/292
4,676,136 A * 6/1987 Kalin ..... F41A 1/08 89/1.703
5,052,302 A * 10/1991 Taddeo ..... F42C 19/0826 102/470
5,109,750 A 5/1992 Kayaian
6,044,746 A * 4/2000 Gendre ..... F42B 5/02 89/1.816
7,624,668 B1 * 12/2009 Sanford ..... F41A 1/08 89/1.701
7,908,971 B2 3/2011 Gustafsson et al.
2002/0195017 A1 12/2002 Priimak
2010/0307131 A1 * 12/2010 Danforth ..... F02K 9/10 102/530
2016/0084059 A1 * 3/2016 Moore ..... E21B 43/247 166/299
2018/0135949 A1 5/2018 Lundgren et al.
2020/0025535 A1 * 1/2020 Binek ..... F42B 10/38
2023/0041671 A1 * 2/2023 Robbins ..... F42B 5/188
2024/0369332 A1 * 11/2024 Esplin ..... F42C 19/0826

FOREIGN PATENT DOCUMENTS

FR 714545 11/1931
RU 2190179 C2 9/2002
WO WO-2016089461 A2 * 6/2016 ..... B22F 1/0059

OTHER PUBLICATIONS

"Pyrotechnic Initiator", Wikipedia, Jul. 7, 2021, XP002809030, Retrieved from the Internet: URL:https://en.wikipedia.org/w/index.php?title=Pyrotechnic_initiator&oldid=1032445085 [retrieved on Apr. 13, 2023].
"40-mm Grenade Launchers", Technical Manual No. 3-22.31 (FM 3-22.31), Nov. 17, 2010, Department of the Army, Washington, DC.
Gary Rosenfield, "AeroTech Warp-9™ Propellant White Paper", Sep. 3, 2006, RCS Rocket Motor Components, Inc., Cedar City, UT.

* cited by examiner

CARTRIDGES FOR RECOIL MANAGEMENT OF SHOULDER FIRED WEAPONS

CROSS-REFERENCE TO RELATED APPLICATION

Benefit is claimed of U.S. Patent Application No. 63/234,465, filed Aug. 18, 2021, and entitled "Cartridges for Recoil Management of Shoulder Fired Weapons", the disclosure of which is incorporated by reference herein in its entirety as if set forth at length.

BACKGROUND

The disclosure relates to firearms. More particularly, the disclosure relates to cartridges for large caliber shoulder-fired firearms.

A class of large caliber firearms includes certain so-called "grenade launchers" and their associated ammunition rounds (cartridges). One current group of examples are 40 mm grenades (e.g., including the NATO standard 40 mm grenades (40×46 mm LV (Low Velocity) and 40×51 mm MV (Medium Velocity))). There are other non-NATO examples. Typical such rounds may be discharged from firearms supported entirely by the user (e.g., as distinguished from firearms mounted to a vehicle or the like which may discharge high velocity rounds).

Typical such firing is shoulder firing wherein the user supports a buttstock against the user's shoulder to react recoil from the firearm. In the case of grenade-launching firearms (grenade launchers), the barrel of such firearm may be an accessory barrel such as one mounted to an existing rifle so that the rifle buttstock reacts recoil to the user's shoulder. Other grenade-launching firearms may be pure grenade-launching firearms (e.g., not mounted to a rifle). The United States Army M320, which fires the NATO standard 40 mm grenade, is convertible with a removable buttstock allowing standalone use with the buttstock or rifle undermount use with the buttstock removed. The M320 has a rifled barrel (tube).

All other factors being equal, to increase projectile velocity recoil must increase. Similarly, to increase projectile mass recoil must increase. However, as recoil increases, use of the firearm will become impractical for ever greater numbers of users. Many 40 mm grenades use a so-called "high-low system" to limit recoil. The high-low cartridge has a small sub-chamber containing the main propellant charge with vents to a main chamber behind the projectile. The vents provide a step-down in pressure to limit pressure acting on the projectile (while sub-chamber pressure is much greater) and thus limit recoil.

Diverse proposals for new forms of projectiles, and the velocity requirements for such projectiles, raise issues of excessive recoil. Such projectiles may include heavy breaching rounds, rocket-propelled missiles, batons, unmanned aircraft systems (UAS) (both quad copter and winged), hover flares, long range smoke grenades, and others. Several rocket-propelled missiles launched from a conventional grenade launchers have been proposed. The missile may be ejected from the launcher by a cartridge's propellant charge. After ejection, the missile's rocket motor will ignite to carry the missile to its target. For such a missile, increased initial velocity imparted by the cartridge propellant may have many advantages. First, it allows the missile to be further from the launcher when the rocket motor kicks in, thereby increasing user safety. Second, it allows the rocket motor to propel the missile to a higher ultimate speed and range.

SUMMARY

One aspect of the disclosure involves a cartridge comprising: a cartridge case extending from a base to a mouth and having an interior; a projectile mounted in the case; and a propellant grain within the case interior. The propellant grain comprises an annular body encircling a centerline of the cartridge.

In a further embodiment of any of the foregoing embodiments, additionally and/or alternatively, the propellant grain is a single continuous full annulus piece.

In a further embodiment of any of the foregoing embodiments, additionally and/or alternatively, wherein the propellant grain comprises a non-convoluted inner diameter surface.

In a further embodiment of any of the foregoing embodiments, additionally and/or alternatively, the propellant grain comprises a right circular cylindrical inner diameter surface.

In a further embodiment of any of the foregoing embodiments, additionally and/or alternatively, the propellant grain comprises a plurality of axial passageways.

In a further embodiment of any of the foregoing embodiments, additionally and/or alternatively, the propellant grain is adhered to an inner diameter (ID) surface of the case.

In a further embodiment of any of the foregoing embodiments, additionally and/or alternatively, the propellant grain is an ammonium perchlorate composite propellant (APCP).

In a further embodiment of any of the foregoing embodiments, additionally and/or alternatively, one or more of: the ammonium perchlorate composite propellant (APCP) is adhered to an inner diameter (ID) surface of the case; the ammonium perchlorate composite propellant (APCP) is a continuous annulus having a right circular cylindrical inner diameter surface and a right circular cylindrical outer diameter surface; and the ammonium perchlorate composite propellant (APCP) is a single piece.

In a further embodiment of any of the foregoing embodiments, additionally and/or alternatively, the propellant grain is in a propellant unit having a fibrous or plastic casing.

In a further embodiment of any of the foregoing embodiments, additionally and/or alternatively, the projectile mass is 0.50 kg to 2.0 kg, more particularly, 0.60 kg to 0.90 kg.

In a further embodiment of any of the foregoing embodiments, additionally and/or alternatively, the cartridge further comprises a primer mounted in the base, the primer comprising a main primer charge. A nozzle is encircled by the propellant grain and comprises a plurality of radially-open outlet ports.

In a further embodiment of any of the foregoing embodiments, additionally and/or alternatively, the main primer charge comprises $BKNO_3$ and the primer further comprises a percussion primer having a percussion primer charge.

In a further embodiment of any of the foregoing embodiments, additionally and/or alternatively, the projectile is a missile having a seeker; and a rocket motor.

In a further embodiment of any of the foregoing embodiments, additionally and/or alternatively, the cartridge contains an ignition train for transferring ignition of the propellant grain to the rocket motor.

In a further embodiment of any of the foregoing embodiments, additionally and/or alternatively, the case comprises: a base piece; and a sidewall piece secured to the base piece.

In a further embodiment of any of the foregoing embodiments, additionally and/or alternatively, a loaded firearm includes the cartridge and further comprises a barrel having: a muzzle; and a chamber accommodating the cartridge.

In a further embodiment of any of the foregoing embodiments, additionally and/or alternatively, the case extends through the muzzle.

In a further embodiment of any of the foregoing embodiments, additionally and/or alternatively, a case length $L_C$ of the projectile is 150 mm to 500 mm, more particularly, 200 mm to 500 mm or 300 mm to 450 mm or about 400 mm. This may be long enough to cover control fins or maneuvering thrusters, if any, and may leave a portion of the projectile protruding. In a further embodiment of any of the foregoing embodiments, additionally and/or alternatively, projectile case diameter Dc in the firearm chamber is 30 mm to 50 mm, more particularly 40.0 mm to 41.5 mm.

In a further embodiment of any of the foregoing embodiments, additionally and/or alternatively, one or more of: the projectile has a solid rocket motor; the projectile protrudes from the case mouth; the barrel is rifled; the firearm is a 40 mm grenade launcher; and the firearm is a shoulder-fired (inclusive of weapon undermount) grenade launcher.

In a further embodiment of any of the foregoing embodiments, additionally and/or alternatively, the barrel is a rifled barrel.

In a further embodiment of any of the foregoing embodiments, additionally and/or alternatively, a method for using the loaded firearm comprises: igniting the primer; combustion gas from the primer passing radially outward to ignite the propellant; and combustion gas from the propellant driving the projectile from the case.

In a further embodiment of any of the foregoing embodiments, additionally and/or alternatively, the projectile is a missile and the combustion gas of the propellant indirectly ignites a motor of the missile.

In a further embodiment of any of the foregoing embodiments, additionally and/or alternatively, a method for manufacturing the cartridge comprises: casting the propellant grain; inserting the cast propellant grain into the case; and inserting the projectile into the case.

In a further embodiment of any of the foregoing embodiments, additionally and/or alternatively, the method further comprises adhering the propellant grain to an inner diameter (ID) surface of the case.

A further aspect of the disclosure involves a cartridge comprising: a cartridge case extending along an axis from a base to a mouth and having an interior; a projectile mounted in the case; and a propellant within the case. The propellant comprises: a propellant grain encircling the axis.

In a further embodiment of any of the foregoing embodiments, additionally and/or alternatively, the projectile is a missile having a rocket motor.

In a further embodiment of any of the foregoing embodiments, additionally and/or alternatively, the propellant grain is an ammonium perchlorate composite propellant (APCP).

In a further embodiment of any of the foregoing embodiments, additionally and/or alternatively, the propellant grain is in a propellant unit having a fibrous or plastic casing.

In a further embodiment of any of the foregoing embodiments, additionally and/or alternatively, the propellant grain is adhered to an inner diameter (ID) surface of the case.

In a further embodiment of any of the foregoing embodiments, additionally and/or alternatively, the propellant grain is a continuous annulus having a right circular cylindrical inner diameter surface and a right circular cylindrical outer diameter surface.

In a further embodiment of any of the foregoing embodiments, additionally and/or alternatively, the propellant grain is a single piece.

In a further embodiment of any of the foregoing embodiments, additionally and/or alternatively, the cartridge further comprises a primer mounted in the base, the primer comprising a main primer charge. A nozzle is encircled by the propellant grain and comprises a plurality of radially-open outlet ports.

In a further embodiment of any of the foregoing embodiments, additionally and/or alternatively, the main primer charge comprises $BKNO_3$ and the primer further comprises a percussion primer having a percussion primer charge.

In a further embodiment of any of the foregoing embodiments, additionally and/or alternatively, the percussion primer (e.g., Boxer or Berdan) may have a cup containing the percussion primer charge and the cup may be mounted in a primer pocket of a primer case which primer case also contains the main primer charge.

In a further embodiment of any of the foregoing embodiments, additionally and/or alternatively, the primer case may be mounted (e.g., press fit) in a primer carrier. The primer carrier may be threaded into the base and may be threaded to (e.g., into) the nozzle.

In a further embodiment of any of the foregoing embodiments, additionally and/or alternatively, the projectile mass is 0.50 kg to 2.0 kg, more particularly, 0.60 kg to 0.90 kg.

In a further embodiment of any of the foregoing embodiments, additionally and/or alternatively, a loaded firearm includes the cartridge and further comprises a barrel having: a muzzle; and a chamber accommodating the cartridge.

In a further embodiment of any of the foregoing embodiments, additionally and/or alternatively, a case length $L_C$ of the projectile is 150 mm to 500 mm, more particularly, 200 mm to 500 mm or 300 mm to 450 mm or about 400 mm. This may be long enough to cover control fins or maneuvering thrusters, if any, and may leave a portion of the projectile protruding. In a further embodiment of any of the foregoing embodiments, additionally and/or alternatively, projectile case diameter Dc in the firearm chamber is 30 mm to 50 mm, more particularly 40.0 mm to 41.5 mm.

In a further embodiment of any of the foregoing embodiments, additionally and/or alternatively, one or more of: the projectile has a solid rocket motor; the projectile protrudes from the case mouth; the barrel is rifled; the firearm is a 40 mm grenade launcher; and the firearm is a shoulder-fired (inclusive of weapon undermount) grenade launcher.

In a further embodiment of any of the foregoing embodiments, additionally and/or alternatively, the case extends through the muzzle.

In a further embodiment of any of the foregoing embodiments, additionally and/or alternatively, the barrel is a rifled barrel.

In a further embodiment of any of the foregoing embodiments, additionally and/or alternatively, a method for using the loaded firearm comprises: igniting the primer; combustion gas from the primer passing radially outward to ignite the propellant; and combustion gas from the propellant driving the projectile from the case.

In a further embodiment of any of the foregoing embodiments, additionally and/or alternatively, the projectile is a missile and the combustion gas of the propellant indirectly ignites a motor of the missile.

In a further embodiment of any of the foregoing embodiments, additionally and/or alternatively, a method for manufacturing the cartridge comprises: casting the propellant grain; inserting the cast propellant grain into the case; and inserting the projectile into the case.

In a further embodiment of any of the foregoing embodiments, additionally and/or alternatively, the method further comprises adhering the propellant grain to an inner diameter (ID) surface of the case.

A further aspect of the disclosure involves a cartridge comprising: a cartridge case extending along an axis from a base to a mouth and having an interior; a projectile mounted in the case; and a propellant within the case. The propellant comprises an ammonium perchlorate composite propellant (APCP).

In a further embodiment of any of the foregoing embodiments, additionally and/or alternatively, one or more of: the projectile is a missile having a rocket motor; the ammonium perchlorate composite propellant (APCP) is an annular grain; the ammonium perchlorate composite propellant (APCP) is in a propellant unit having a fibrous or plastic casing; the ammonium perchlorate composite propellant (APCP) is adhered to an inner diameter (ID) surface of the case; the ammonium perchlorate composite propellant (APCP) is a continuous annulus having a right circular cylindrical inner diameter surface and a right circular cylindrical outer diameter surface; and the ammonium perchlorate composite propellant (APCP) is a single piece.

In a further embodiment of any of the foregoing embodiments, additionally and/or alternatively, the cartridge further comprises a primer mounted in the base, the primer comprising, a main primer charge. A nozzle is encircled by the propellant grain and comprises a plurality of radially-open outlet ports.

In a further embodiment of any of the foregoing embodiments, additionally and/or alternatively, the main primer charge comprises $BKNO_3$; and the primer further comprises a percussion primer having a percussion primer charge.

In a further embodiment of any of the foregoing embodiments, additionally and/or alternatively, the projectile mass is 0.50 kg to 2.0 kg, more particularly, 0.60 kg to 0.90 kg.

In a further embodiment of any of the foregoing embodiments, additionally and/or alternatively, a case length $L_C$ of the projectile is 150 mm to 500 mm, more particularly, 200 mm to 500 mm or 300 mm to 450 mm or about 400 mm. This may be long enough to cover control fins or maneuvering thrusters, if any, and may leave a portion of the projectile protruding. In a further embodiment of any of the foregoing embodiments, additionally and/or alternatively, projectile case diameter Dc in the firearm chamber is 30 mm to 50 mm, more particularly 40.0 mm to 41.5 mm.

In a further embodiment of any of the foregoing embodiments, additionally and/or alternatively, a loaded firearm includes the cartridge and further comprises a barrel having: a muzzle; and a chamber accommodating the cartridge.

In a further embodiment of any of the foregoing embodiments, additionally and/or alternatively, one or more of: the projectile has a solid rocket motor; the projectile protrudes from the case mouth; the barrel is rifled; the firearm is a 40 mm grenade launcher; and the firearm is a shoulder-fired (inclusive of weapon undermount) grenade launcher.

In a further embodiment of any of the foregoing embodiments, additionally and/or alternatively, the case extends through the muzzle.

In a further embodiment of any of the foregoing embodiments, additionally and/or alternatively, the barrel is a rifled barrel.

In a further embodiment of any of the foregoing embodiments, additionally and/or alternatively, a method for using the loaded firearm comprises: igniting the primer; combustion gas from the primer passing radially outward to ignite the propellant; and combustion gas from the propellant driving the projectile from the case.

In a further embodiment of any of the foregoing embodiments, additionally and/or alternatively, the projectile is a missile and the combustion gas of the propellant indirectly ignites a motor of the missile.

In a further embodiment of any of the foregoing embodiments, additionally and/or alternatively, a method for manufacturing the cartridge comprises: casting the propellant grain; inserting the cast propellant grain into the case; and inserting the projectile into the case.

In a further embodiment of any of the foregoing embodiments, additionally and/or alternatively, the method further comprises adhering the propellant grain to an inner diameter (ID) surface of the case.

A further aspect of the disclosure involves a cartridge comprising: a cartridge case extending along an axis from a base to a mouth and having an interior; a projectile mounted in the case; a propellant within the case; and a primer mounted in the base. The primer comprises a main primer charge. A nozzle is encircled by the propellant grain and comprises a plurality of radially-open outlet ports.

In a further embodiment of any of the foregoing embodiments, additionally and/or alternatively, the main primer charge comprises $BKNO_3$.

In a further embodiment of any of the foregoing embodiments, additionally and/or alternatively, the primer further comprises a percussion primer having a percussion primer charge.

In a further embodiment of any of the foregoing embodiments, additionally and/or alternatively, the percussion primer (e.g., Boxer or Berdan) may have a cup containing the percussion primer charge and the cup may be mounted in a primer pocket of a primer case which primer case also contains the main primer charge.

In a further embodiment of any of the foregoing embodiments, additionally and/or alternatively, the primer case may be mounted (e.g., press fit) in a primer carrier. The primer carrier may be threaded into the base and may be threaded to (e.g., into) the nozzle.

In a further embodiment of any of the foregoing embodiments, additionally and/or alternatively, the projectile mass is 0.50 kg to 2.0 kg, more particularly, 0.60 kg to 0.90 kg.

In a further embodiment of any of the foregoing embodiments, additionally and/or alternatively, a loaded firearm includes the cartridge and further comprises a barrel having: a muzzle; and a chamber accommodating the cartridge.

In a further embodiment of any of the foregoing embodiments, additionally and/or alternatively, the case extends through the muzzle.

In a further embodiment of any of the foregoing embodiments, additionally and/or alternatively, a case length $L_C$ of the projectile is 150 mm to 500 mm, more particularly, 200 mm to 500 mm or 300 mm to 450 mm or about 400 mm. This may be long enough to cover control fins or maneuvering thrusters, if any, and may leave a portion of the projectile protruding. In a further embodiment of any of the foregoing embodiments, additionally and/or alternatively, projectile case diameter Dc in the firearm chamber is 30 mm to 50 mm, more particularly 40.0 mm to 41.5 mm.

In a further embodiment of any of the foregoing embodiments, additionally and/or alternatively, the barrel is a rifled barrel.

In a further embodiment of any of the foregoing embodiments, additionally and/or alternatively, one or more of: the projectile has a solid rocket motor; the projectile protrudes from the case mouth; the barrel is rifled; the firearm is a 40 mm grenade launcher; and the firearm is a shoulder-fired (inclusive of weapon undermount) grenade launcher.

In a further embodiment of any of the foregoing embodiments, additionally and/or alternatively, a method for using the loaded firearm comprises: igniting the primer; combustion gas from the primer passing radially outward to ignite the propellant; and combustion gas from the propellant driving the projectile from the case.

In a further embodiment of any of the foregoing embodiments, additionally and/or alternatively, the projectile is a missile and the combustion gas of the propellant indirectly ignites a motor of the missile.

In a further embodiment of any of the foregoing embodiments, additionally and/or alternatively, a method for manufacturing the cartridge comprises: casting the propellant grain; inserting the cast propellant grain into the case; and inserting the projectile into the case.

In a further embodiment of any of the foregoing embodiments, additionally and/or alternatively, the method further comprises adhering the propellant grain to an inner diameter (ID) surface of the case.

A further aspect of the disclosure involves a loaded firearm comprising a barrel and a cartridge. The barrel has a muzzle and a chamber. The cartridge has: a cartridge case extending from a base to a mouth and having an interior, a portion of the case accommodated in the chamber; a projectile mounted in the case; and a propellant within the case interior. The case mouth protrudes from the barrel muzzle.

In a further embodiment of any of the foregoing embodiments, additionally and/or alternatively, one or more of: the projectile has a solid rocket motor; the projectile protrudes from the case mouth; the barrel is rifled; the firearm is a 40 mm grenade launcher; and the firearm is a shoulder-fired (inclusive of weapon undermount) grenade launcher.

In a further embodiment of any of the foregoing embodiments, additionally and/or alternatively, the projectile mass is 0.50 kg to 2.0 kg, more particularly, 0.60 kg to 0.90 kg.

In a further embodiment of any of the foregoing embodiments, additionally and/or alternatively, a case length $L_C$ of the projectile is 150 mm to 500 mm, more particularly, 200 mm to 500 mm or 300 mm to 450 mm or about 400 mm. This may be long enough to cover control fins or maneuvering thrusters, if any, and may leave a portion of the projectile protruding. In a further embodiment of any of the foregoing embodiments, additionally and/or alternatively, projectile case diameter Dc in the firearm chamber is 30 mm to 50 mm, more particularly 40.0 mm to 41.5 mm.

In a further embodiment of any of the foregoing embodiments, additionally and/or alternatively, a method for using the loaded firearm comprises: igniting the primer; combustion gas from the primer passing radially outward to ignite the propellant; and combustion gas from the propellant driving the projectile from the case.

In a further embodiment of any of the foregoing embodiments, additionally and/or alternatively, the projectile is a missile and the combustion gas of the propellant indirectly ignites a motor of the missile.

In a further embodiment of any of the foregoing embodiments, additionally and/or alternatively, a method for manufacturing the cartridge comprises: casting the propellant grain; inserting the cast propellant grain into the case; and inserting the projectile into the case.

In a further embodiment of any of the foregoing embodiments, additionally and/or alternatively, the method further comprises adhering the propellant grain to an inner diameter (ID) surface of the case.

Other embodiments of any of the foregoing aspects and embodiments involve methods for using the cartridges and weapons.

The features of the various embodiments may be further combined and interchanged other than as specifically discussed.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

Figure 1:
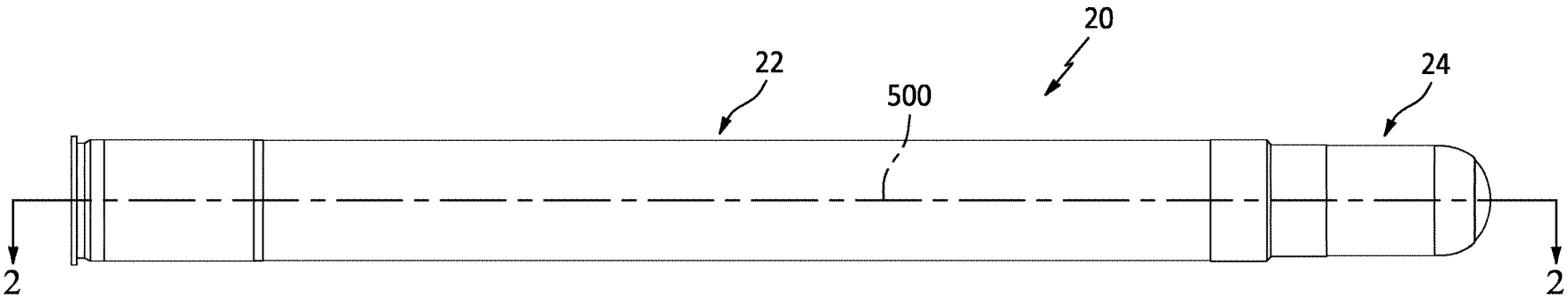
FIG. 1 is a side view of a missile cartridge.
Figure 2:
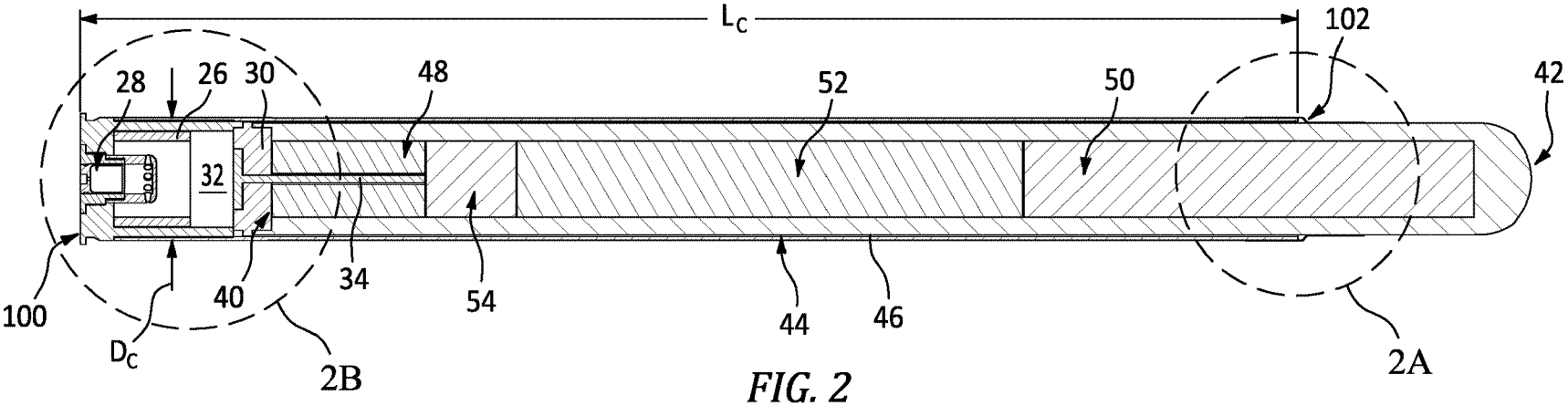
FIG. 2 is a central longitudinal sectional view of the cartridge of FIG. 1, taken along line 2-2.
Figure 2A:
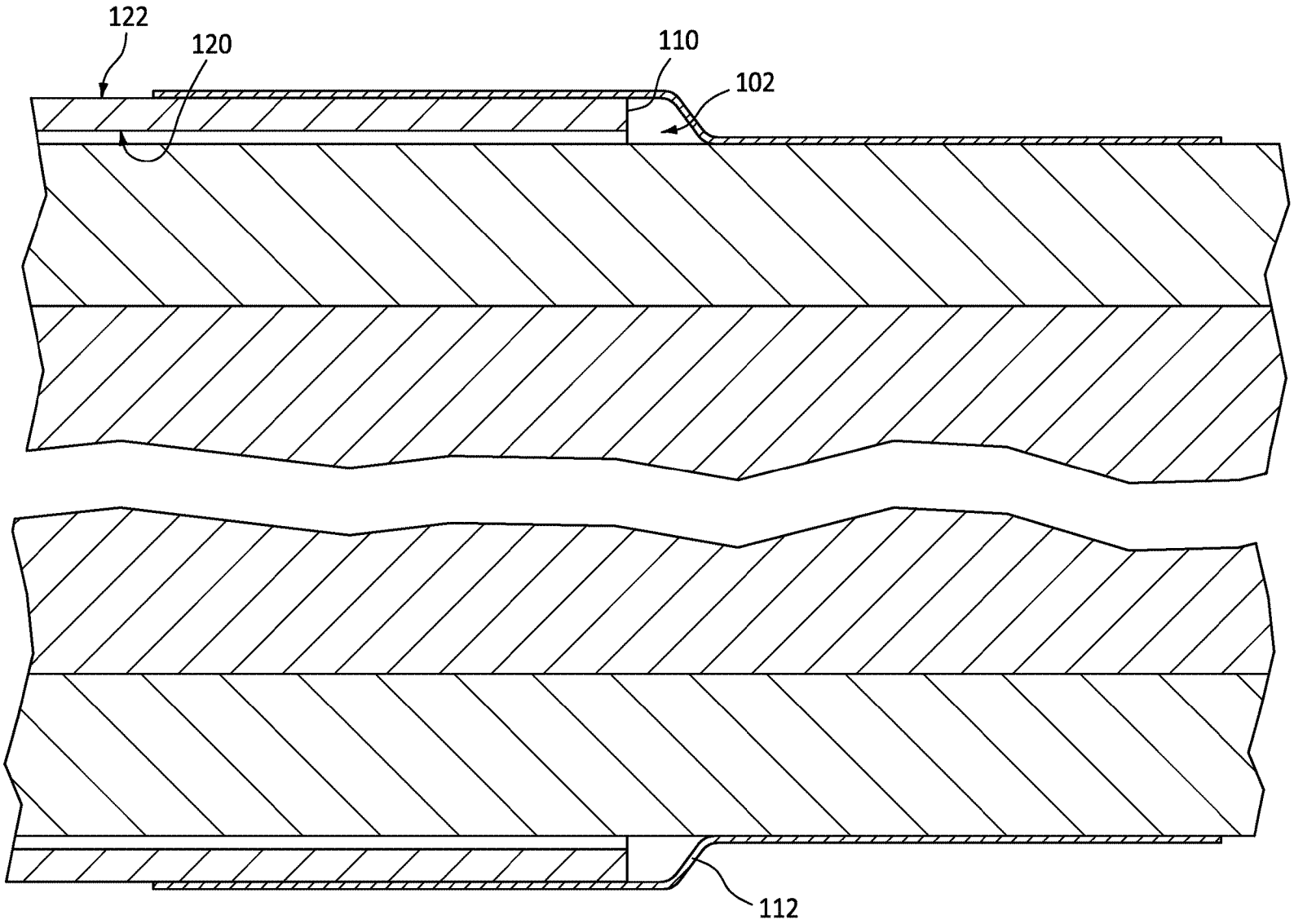
FIG. 2A is an enlarged view of an intermediate portion of the cartridge of FIG. 1.
Figure 2B:
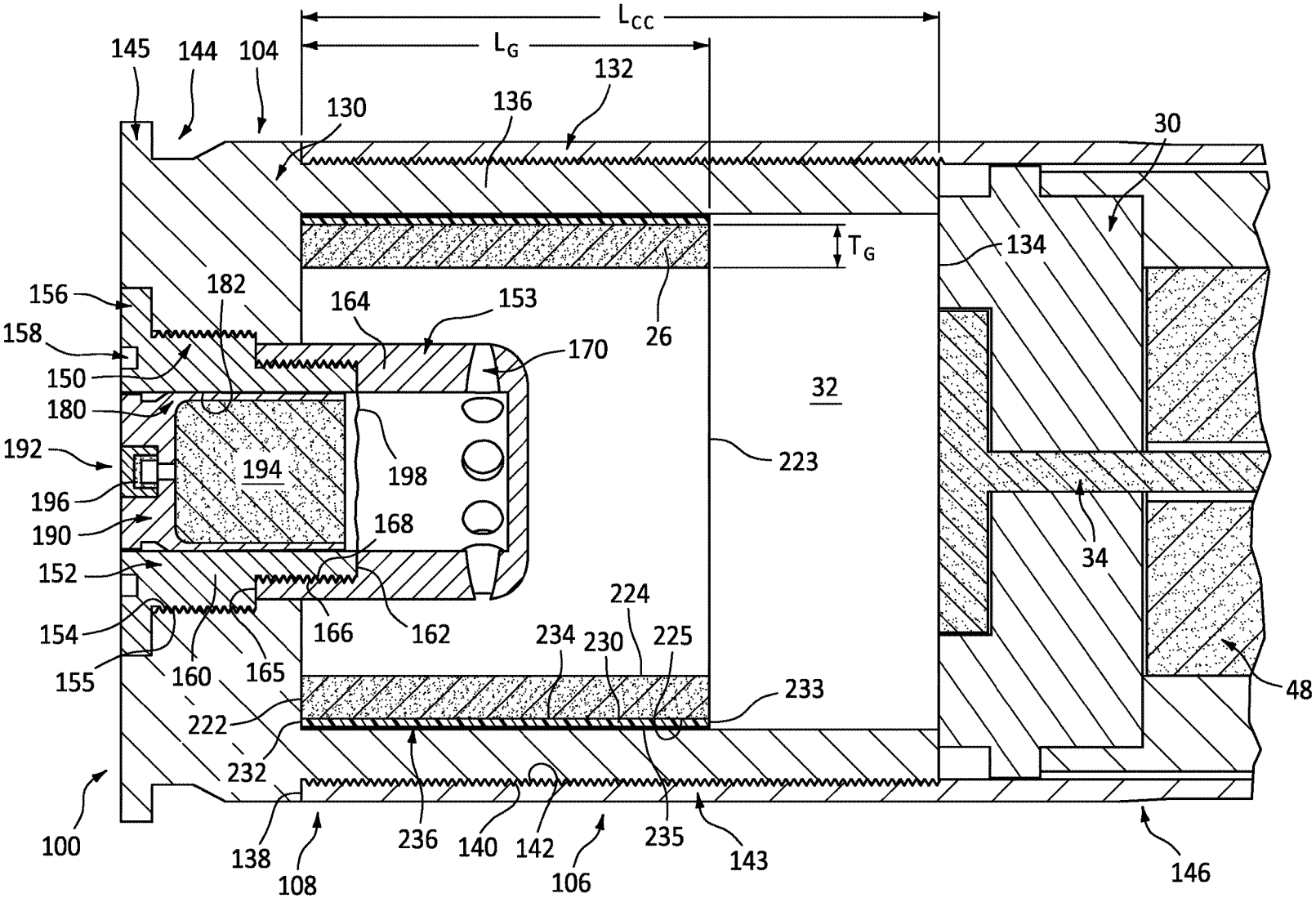
FIG. 2B is an enlarged view of an aft portion of the cartridge of FIG. 1.
Figure 3:
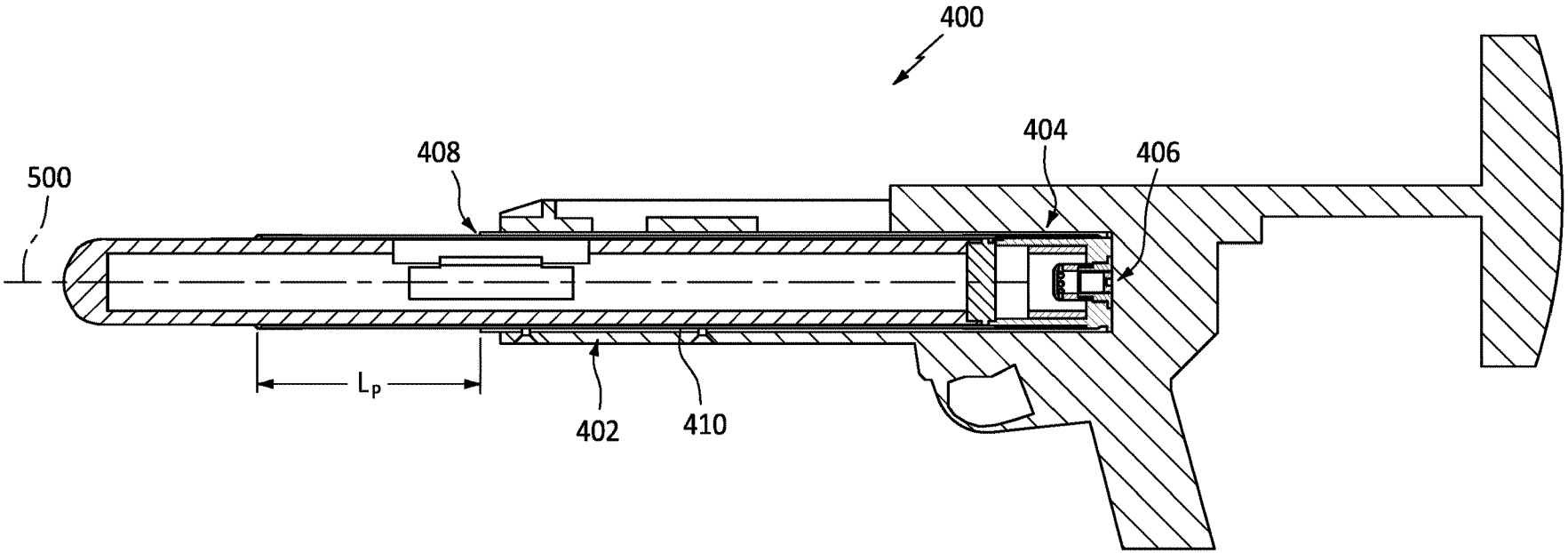
FIG. 3 is a partially schematic longitudinal sectional view of a grenade launcher chambering the missile cartridge.
Figure 4:
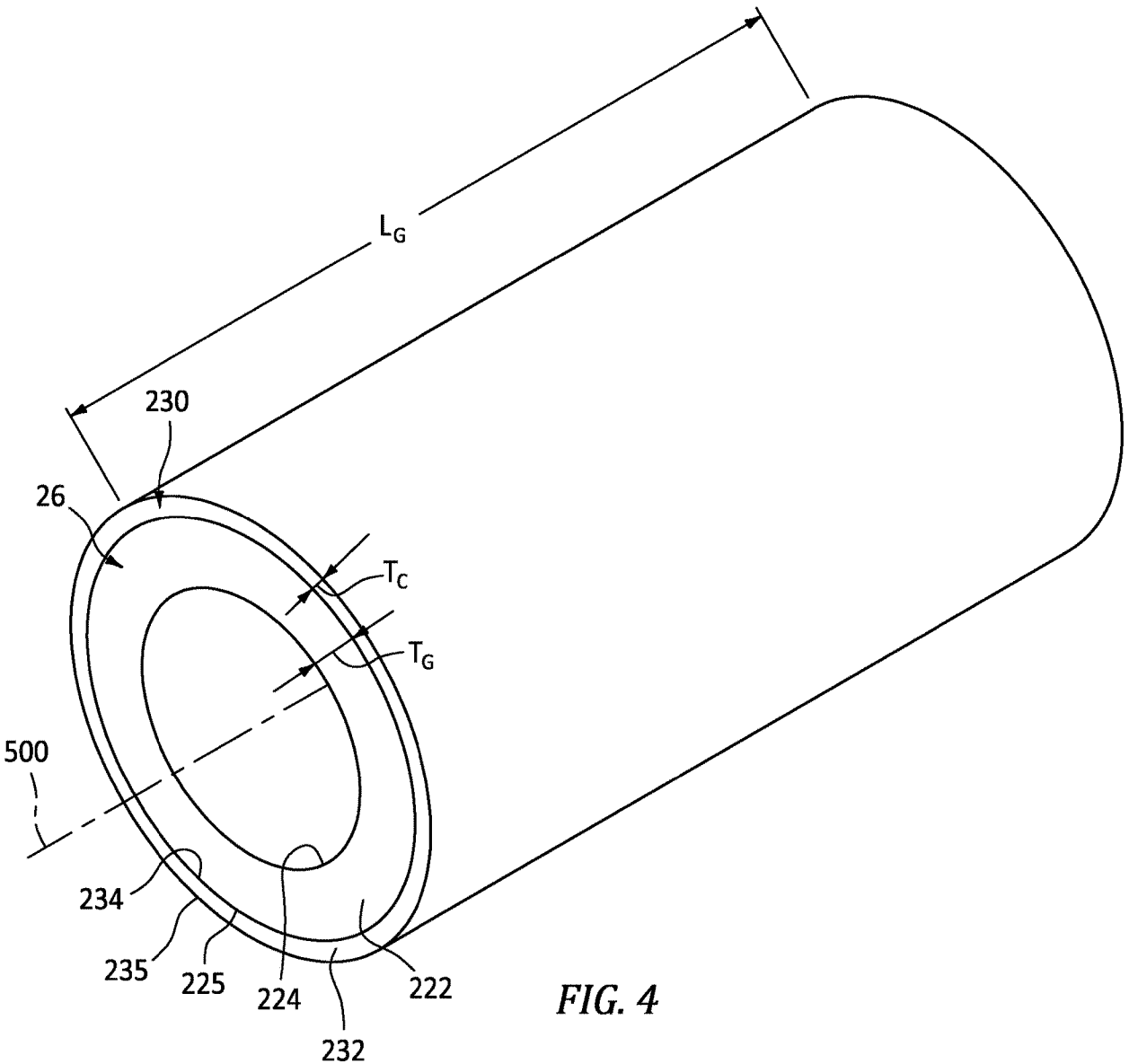
FIG. 4 is a view of a propellant unit of the cartridge of FIG. 1.
Figure 5:
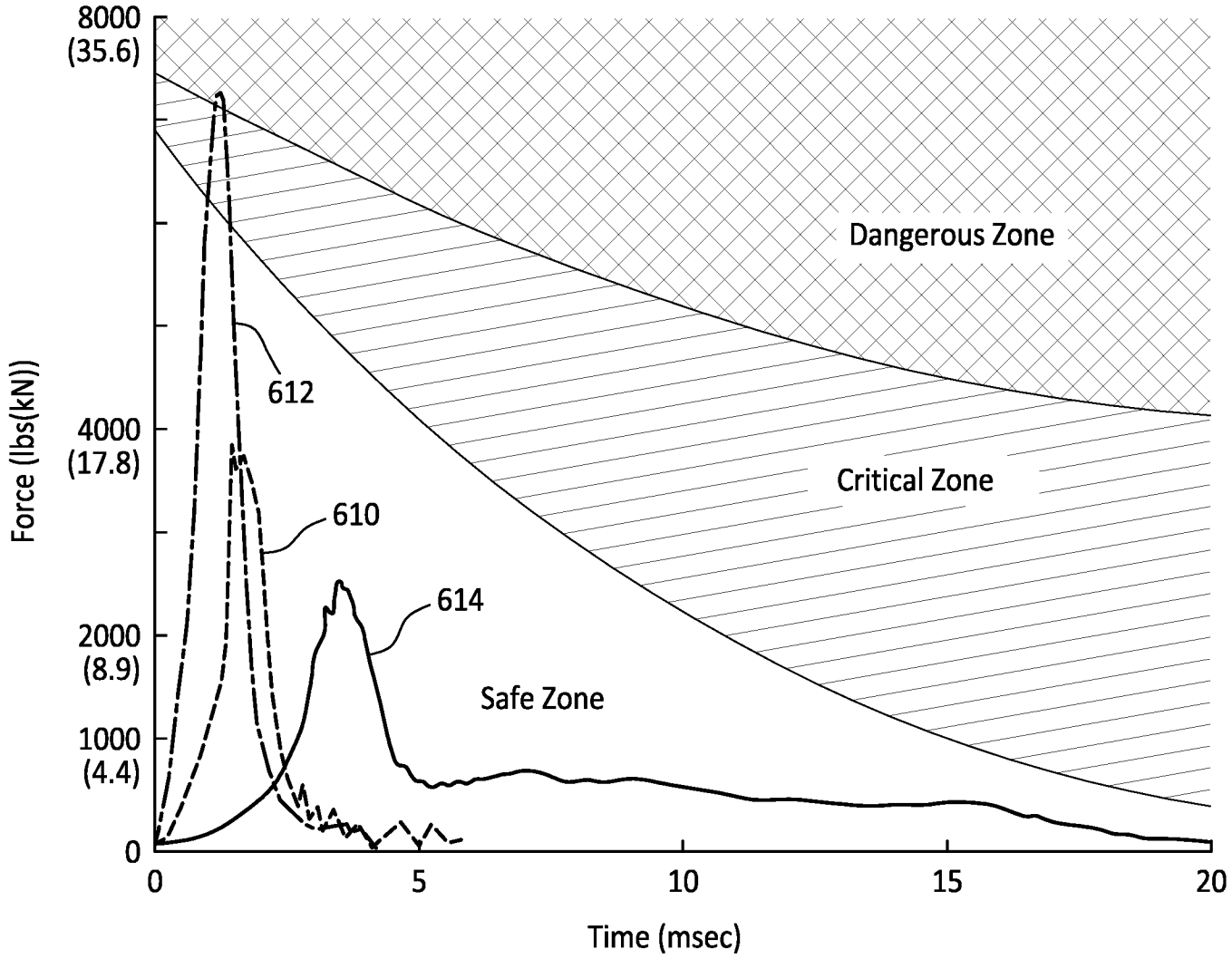
FIG. 5 is a plot of recoil force versus time for firing of the grenade launcher of FIG. 1.
Figure 6:
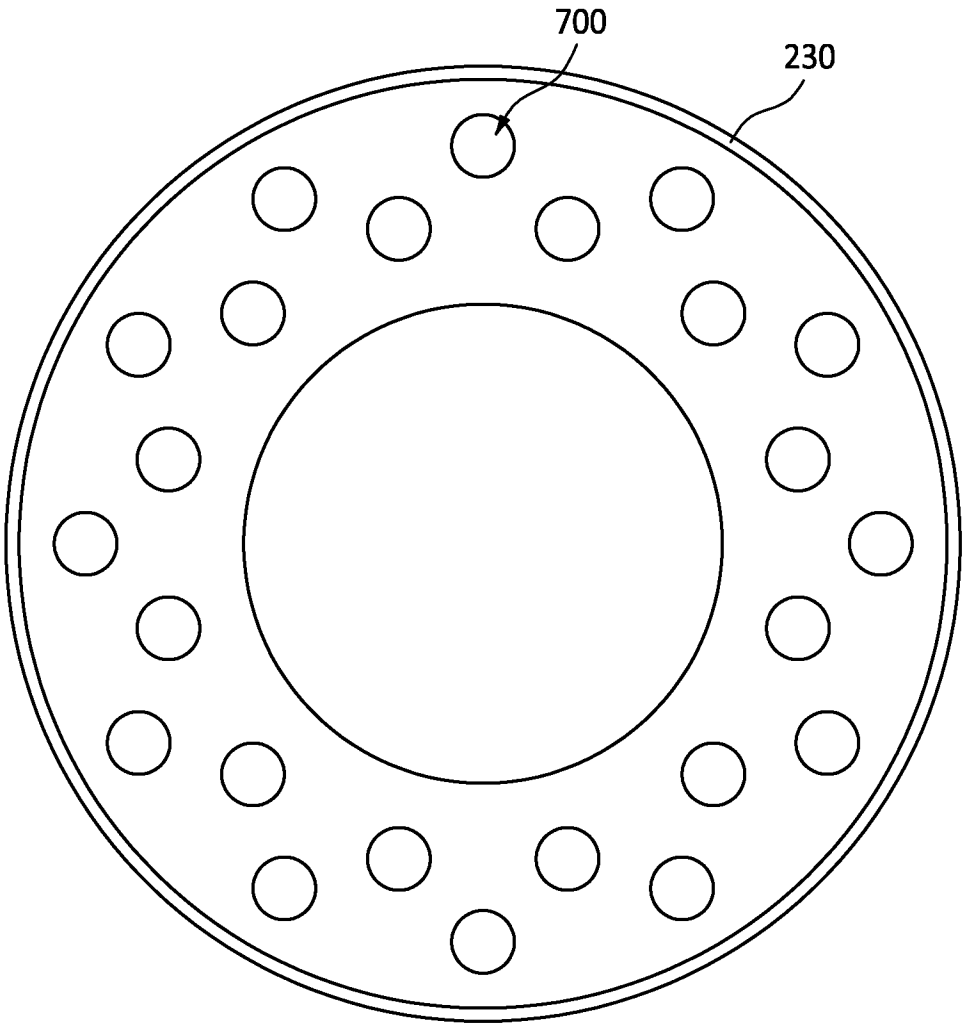
FIG. 6 is an end view of an alternate propellant unit.

What is claimed is:

1. A cartridge (20) comprising:

a cartridge case (22) extending from a base (104) to a mouth (102) and having an interior;

a projectile (24) mounted in the case and having a rocket motor (48);

a primer (28) mounted in the base, the primer comprising:

a main primer charge (194); and a percussion primer (192) having a percussion primer charge (196); and a propellant grain (26) within the case interior, wherein:

a nozzle (153) is encircled by the propellant grain and comprises a plurality of radially-open outlet ports (170); and the propellant grain comprises an annular body encircling a centerline (500) of the cartridge.

2. The cartridge of claim 1 wherein the propellant grain is a single continuous full annulus piece.

3. The cartridge of claim 1 wherein the propellant grain comprises:

a non-convoluted inner diameter surface (224).

4. The cartridge of claim 1 wherein the propellant grain comprises:

a right circular cylindrical inner diameter surface (224).

5. The cartridge of claim 1 wherein the propellant grain comprises:

a plurality of axial passageways (700).

6. The cartridge of claim 1 wherein:

the propellant grain is adhered (236) to an inner diameter (ID) surface of the case.

7. The cartridge of claim 1 wherein:

the propellant grain is an ammonium perchlorate composite propellant (APCP).

8. The cartridge of claim 1 wherein:

the propellant grain is in a propellant unit having a fibrous or plastic casing (230).

9. The cartridge of claim 1 wherein:

the primer further comprises a primer case (190) containing the main primer charge and having a primer pocket (180); and the percussion primer (192) has a cup mounted in the primer pocket and containing the percussion primer charge (196).

10. The cartridge of claim 9 wherein:

the main primer charge (194) comprises $BKNO_3$.

11. The cartridge of claim 1 wherein:

the projectile is a missile having:

a seeker (50); and the rocket motor (48); and/or the cartridge contains an ignition train (34) for transferring ignition of the propellant grain to the rocket motor; and/or the case comprises:

a base piece (130); and a sidewall piece (132) secured to the base piece.

12. A loaded firearm (400) including the cartridge of claim 1 and further comprising a barrel (402) having:

a muzzle (408); and a chamber (404) accommodating the cartridge.

13. The loaded firearm of claim 12 wherein:

the case extends through the muzzle.

14. The loaded firearm of claim 12 wherein:

the barrel is a rifled (410) barrel.

15. A method for manufacturing the cartridge of claim 1, the method comprising:

casting the propellant grain;

inserting the cast propellant grain into the case; and inserting the projectile into the case.

16. The method of claim 15 further comprising:

adhering the propellant grain to an inner diameter (ID) surface of the case.

17. A method for using the loaded firearm of claim 12, the method comprising:

igniting the primer;

combustion gas from the primer passing radially outward to ignite the propellant; and combustion gas from the propellant driving the projectile from the case.

18. The method of claim 17 wherein:

the projectile is a missile; and the combustion gas of the propellant indirectly ignites the rocket motor.

19. A loaded firearm (400) comprising:

a barrel (402) having:

a muzzle (408); and a chamber (404); and a cartridge (20) accommodated by the chamber and comprising:

a cartridge case (22) extending from a base (104) to a mouth (102) and having an interior;

a projectile (24) mounted in the case;

a primer (28) mounted in the base, the primer comprising:

a main primer charge (194); and a percussion primer (192) having a percussion primer charge (196); and a propellant grain (26) within the case interior, wherein:

the cartridge has a nozzle (153) encircled by the propellant grain and comprises a plurality of radially-open outlet ports (170);

the propellant grain comprises an annular body encircling a centerline (500) of the cartridge; and the case extends through the muzzle.

20. The loaded firearm of claim 19 wherein:

the barrel is a rifled (410) barrel.

21. The loaded firearm of claim 19 wherein:

the projectile protrudes from the case mouth.

* * * * *